United States Patent [19]

Matsumura et al.

[11] Patent Number: 4,495,920

[45] Date of Patent: Jan. 29, 1985

[54] ENGINE CONTROL SYSTEM AND METHOD FOR MINIMIZING CYLINDER-TO-CYLINDER SPEED VARIATIONS

[75] Inventors: Toshimi Matsumura, Aichi; Masahiko Miyaki; Hitoshi Tomishima, both of Oobu; Akira Masuda, Aichi, all of Japan

[73] Assignee: Nippondenso Co., Ltd., Kariya, Japan

[21] Appl. No.: 482,884

[22] Filed: Apr. 7, 1983

[30] Foreign Application Priority Data

| | | | |
|---|---|---|---|
| Apr. 9, 1982 | [JP] | Japan | 57-60164 |
| Jun. 7, 1982 | [JP] | Japan | 57-97286 |
| Jun. 8, 1982 | [JP] | Japan | 57-98373 |

[51] Int. Cl.[3] ..... F02B 3/00

[52] U.S. Cl. ..... 123/436; 123/480

[58] Field of Search ..... 123/436, 419, 480, 486, 123/458

[56] References Cited

U.S. PATENT DOCUMENTS

| | | | |
|---|---|---|---|
| 1,664,610 | 4/1928 | French | 123/458 |
| 3,146,769 | 9/1964 | Hall | 123/458 |
| 4,197,767 | 4/1980 | Leung | 123/436 |
| 4,301,780 | 11/1981 | Hoshi | 123/486 |
| 4,357,662 | 11/1982 | Schira | 123/436 |
| 4,357,925 | 11/1982 | Woodruff | 123/458 |
| 4,379,442 | 4/1983 | Simko | 123/458 |
| 4,418,669 | 12/1983 | Johnson | 123/436 |

*Primary Examiner*—Ronald B. Cox

*Attorney, Agent, or Firm*—Cushman, Darby & Cushman

[57] ABSTRACT

In a fuel injection control system for multi-cylinder internal combustion engines, the speed of the engine is monitored and sampled at predetermined angular intervals of engine revolution to detect instantaneous engine speed values identifiable by individual cylinders. From the successively detected instantaneous speeds is derived an average value which is used as a reference for the instantaneous speed values to detect their deviations therefrom. Cylinder-to-cylinder variations in engine speed are minimized by metering the fuel according to the individually derived engine speed deviations.

8 Claims, 10 Drawing Figures

ENGINE CONTROL SYSTEM AND METHOD FOR MINIMIZING CYLINDER-TO-CYLINDER SPEED VARIATIONS

BACKGROUND OF THE INVENTION

The present invention relates to electronic fuel injection, and more particularly to a method and system for injecting different quantities of fuel to individual cylinders so that cylinder-to-cylinder engine speed variations are minimized.

In conventional electronic fuel injection systems, engine speed and load parameters are continuously monitored and a single control variable is derived for metering the amount of fuel to be injected to all the injectors. One disadvantage of the prior art system resides in the fact that due to manufacturing tolerances and aging, the cross-sectional areas of the individual fuel injectors tend to differ from one another. Since the single control variable is used indiscriminately for all injectors, engine speed variations develop from one cylinder to the next with conventional fuel injection systems and will eventually cause engine instability. This is particularly severe when the engine is idled, making it difficult to regulate noxious emissions to within a narrow control range.

SUMMARY OF THE INVENTION

An object of the present invention is therefore to provide a method and system for individually controlling the fuel injectors to minimize cylinder-to-cylinder engine speed variations.

According to the present invention, the speed of a multi-cylinder engine is detected and sampled at predetermined angular intervals of engine revolution to detect instantaneous speed values of the engine in association with the operations of individual cylinders. The instantaneous engine speed values are thus identifiable by individual cylinders. From the successively detected instantaneous speeds is derived an average value which is used as a reference for the instantaneous speed values to detect their deviations therefrom. Cylinder-to-cylinder variations in engine speed are minimized by metering the fuel according to the individually derived engine speed deviations.

BRIEF DESCRIPTION OF THE DRAWINGS

The present invention will be described in further detail with reference to the accompanying drawings, in which.

DETAILED DESCRIPTION

Figure 1:
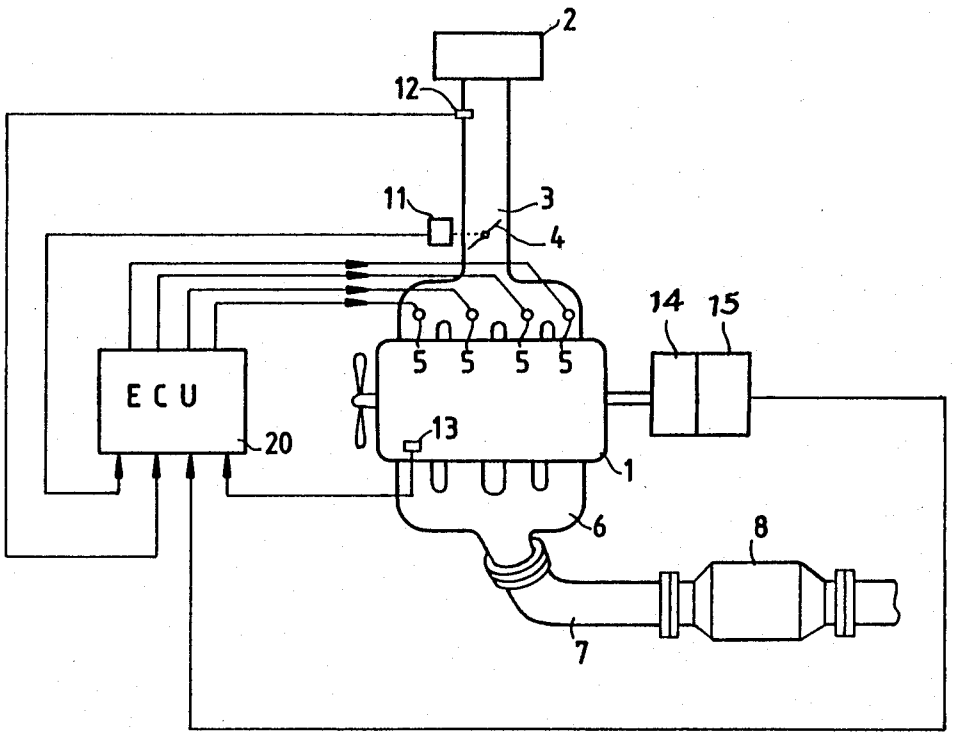
FIG. 1 is a block diagram of a multi-cylinder internal combustion engine and a control unit for operating the fuel injectors of the engine.

In FIG. 1, a four-cycle, spark ignition internal combustion engine 1 draws in intake air through an air cleaner 2 and intake manifold 3 having a throttle valve 4 therein. Fuel is supplied by solenoid-operated injector valves 5 at individual spark advance timing in response to injector control signals delivered from an electronic control unit 20. Emissions are exhausted through exhaust manifold 6, pipe 7 and through a known catalytic converter 8 out into the atmosphere. A potentiometer arrangement 11 is coupled to the throttle valve 4 to generate an analog signal proportional to throttle opening as a representative of the engine load. An air temperature sensor or thermistor 12 is located in the intake passage 3 to generate a signal indicating the temperature of the drawn air. An engine coolant temperature sensor 13 also provides a coolant temperature signal. Illustrated at 14 is an engine speed sensor which generates a series of pulses having a frequency proportional to the speed of the engine 1. A cylinder sensor 15 is also provided to generate a cylinder identification code in response to the injection of fuel into the No. 1 cylinder of the engine. The control unit 20 operates on the signals from the sensors 11 to 15 to derive an optimum quantity of fuel for each cylinder and generates injector control signals representing the on-time of each injector valve 5.

Figure 2:
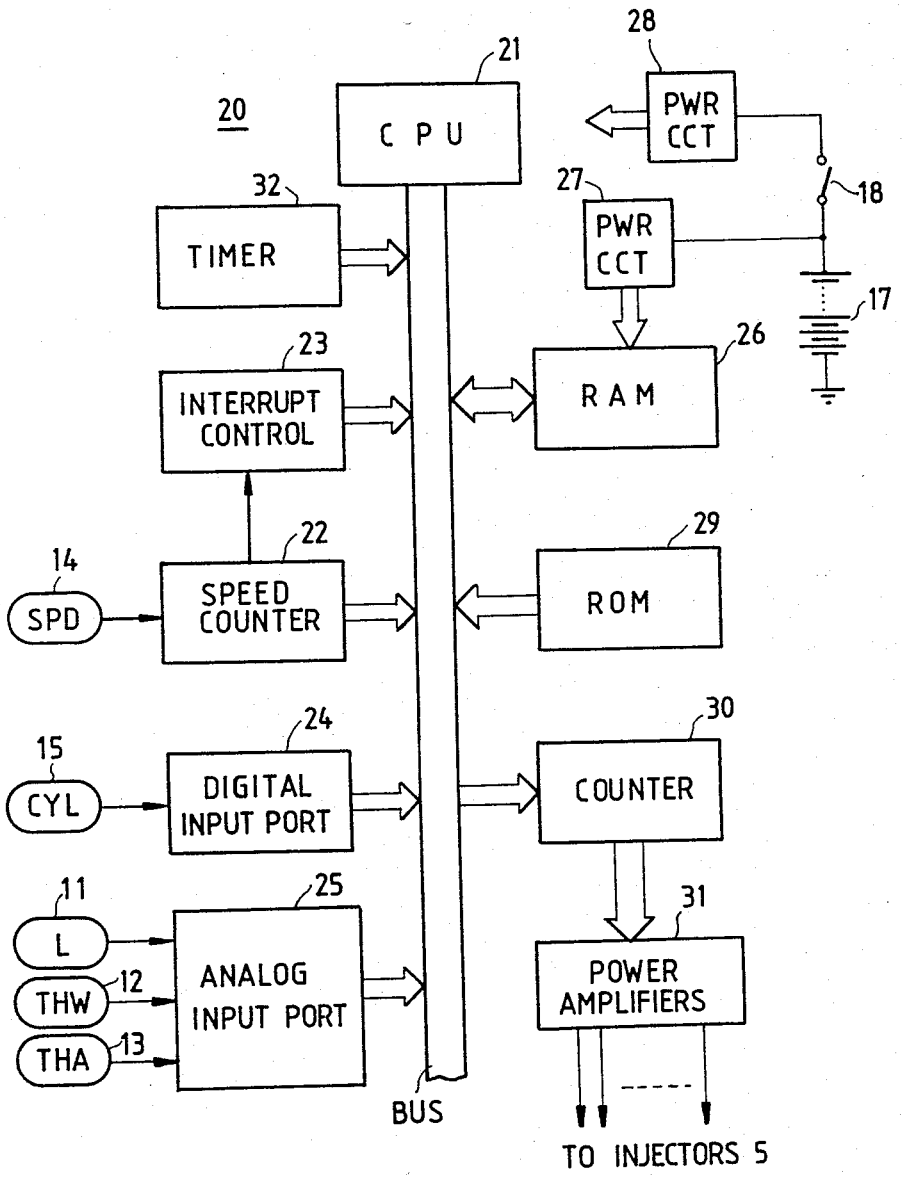
FIG. 2 is a block diagram illustrating the detail of the control unit of FIG. 1.

As shown in detail in FIG. 2, the control unit 20 typically comprises a microcomputer including a microprocessor or CPU 21, an engine speed counter 22 and an interrupt control section 23. The pulse signal from the engine speed sensor 14 is applied to the speed counter 22 to measure the engine speed for each half revolution of the engine 1 which in turn signals the interrupt control unit 23 to cause it to provide an interrupt command signal to the microprocessor 21. The microprocessor 21 interrupts its main routine operation to initiate an interrupt routine in which fuel injection quantity is determined. Cylinder identification codes are applied to the microprocessor 21 via a digital input port 24. The analog outputs of throttle sensor 11 and temperature sensors 12 and 13 are converted into corresponding digital signals in an analog input port 25. A random access memory 26 is permanently connected to the battery 17 via a power circuit 27, while another power circuit 28 which is connected to the battery through an ignition key switch 18 supplies power to the other units of the microcomputer. Therefore, the data previously stored in the memory 26 are made available for subsequent engine operation after the ignition key is turned off. The programmed instructions for the microprocessor 21 are stored in a read only memory 29. A downcounter unit 30 converts injection quantity data derived in the microprocessor 20 into a pulse having a corresponding duration and applies the injection pulses through amplifiers 31 to the individual injector valves 5. Various timing signals are supplied from a timer 32.

Figure 3A:
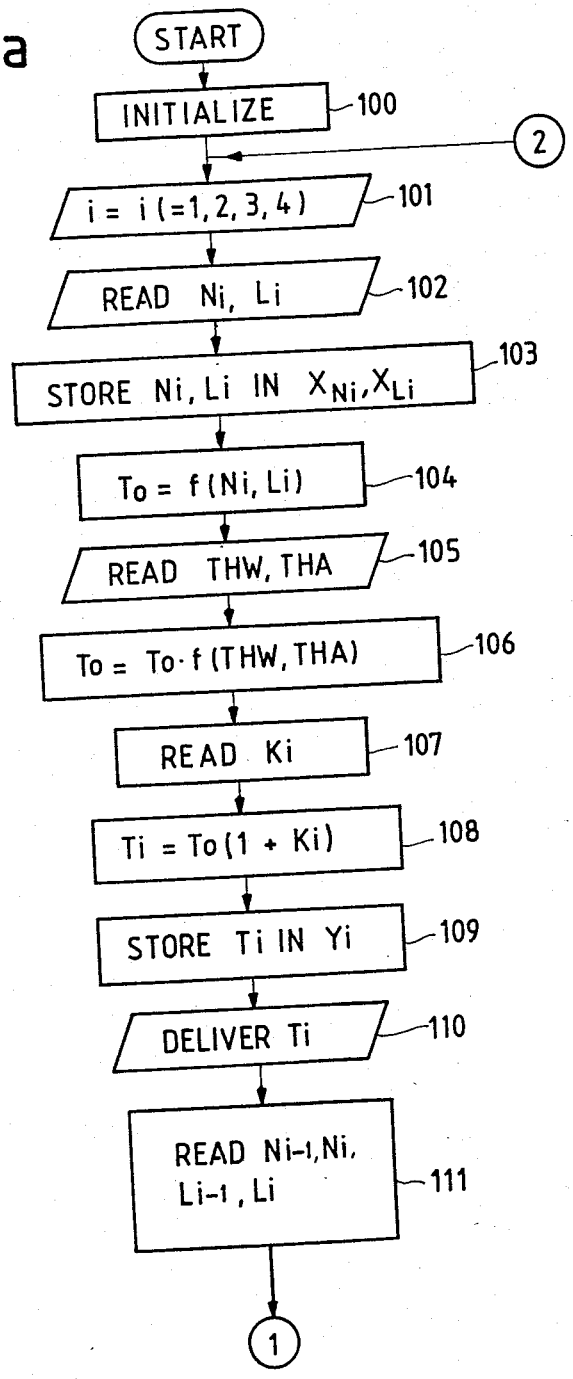
FIGS. 3*a* to 3*c* are a flowchart describing the steps of instructions programmed in a microcomputer.
Figure 3B:
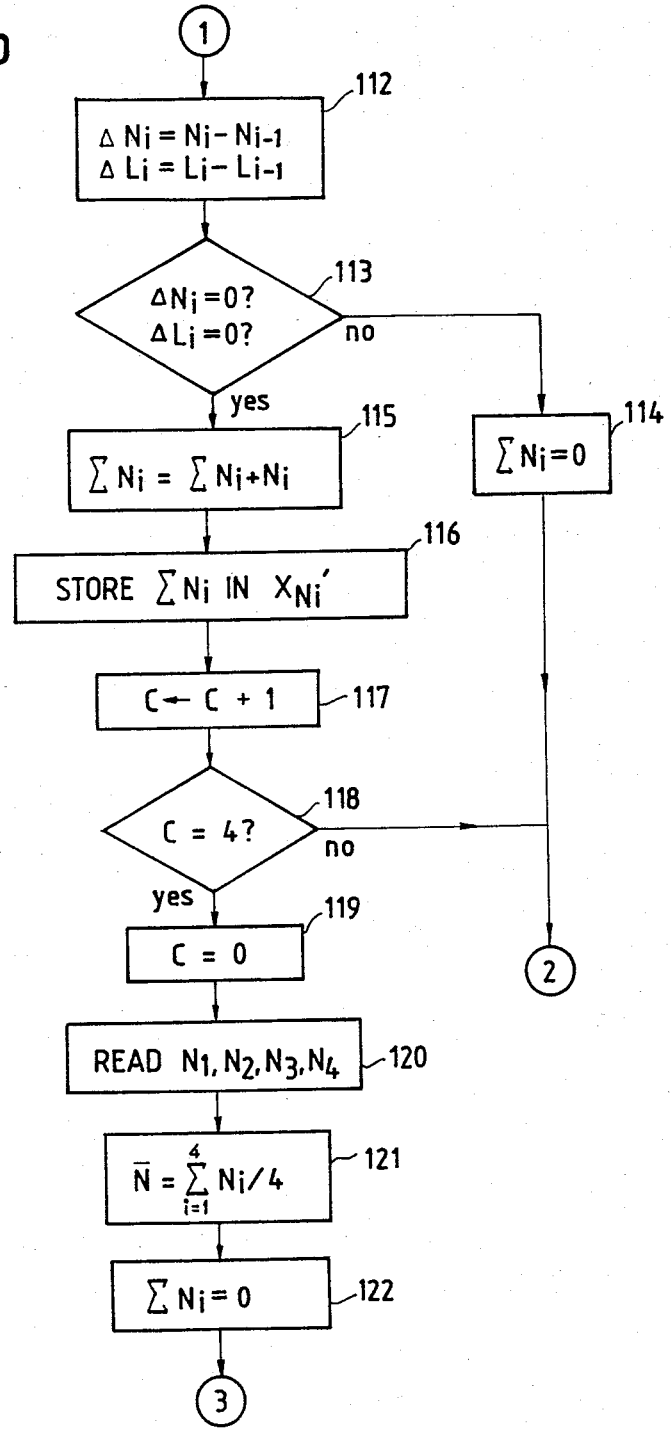
Figure 3C:
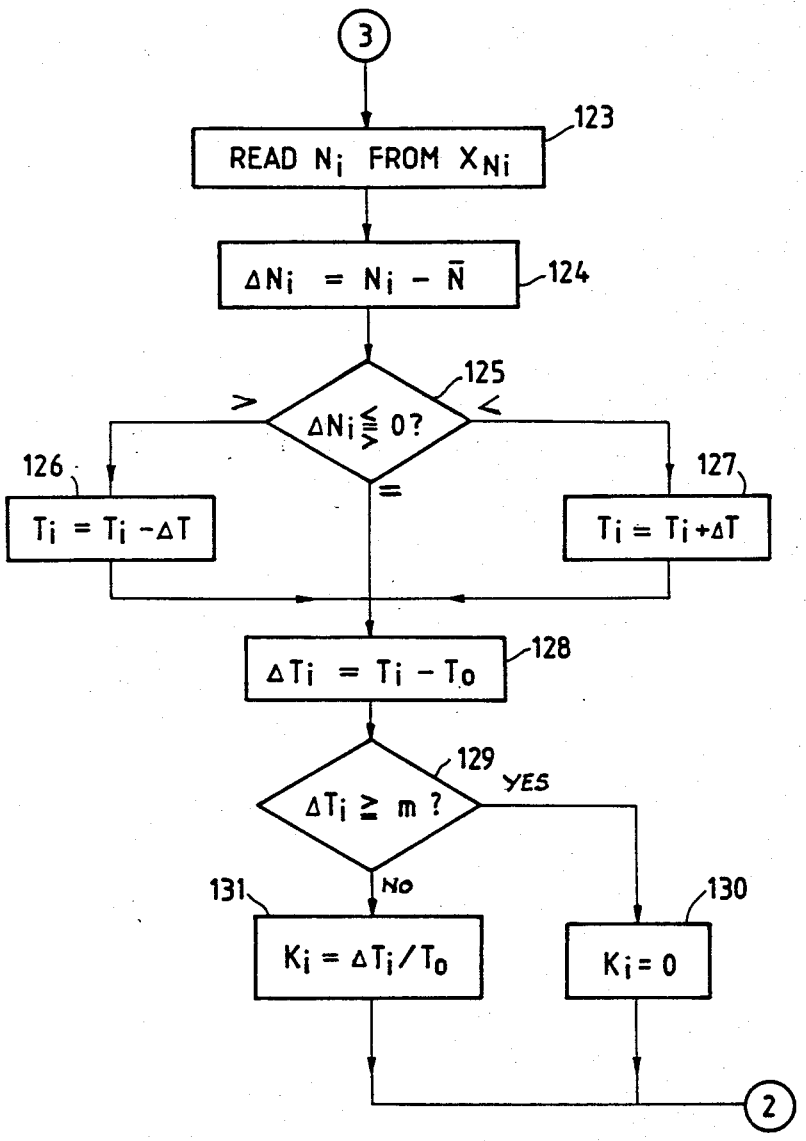

In response to an interrupt command issued from the interrupt control unit 23, the microprocessor 21 exits from the main routine in which it controls the engine's air-fuel mixture and ignition timing and the like and enters an interrupt routine shown in FIGS. 3*a* to 3*c*. The interrupt routine starts with an initializing step in which various registers are reset to predetermined initial values. In Step 101 the microprocessor reads the No. 1 cylinder identification code off the digital input port 24 and the output of engine speed counter 22 to identify the cylinder into which fuel is injected, and goes on to set a "variable" "i" to a value corresponding to the identified cylinder number by storing it in a cylinder identification register. In Step 102 an engine speed value $N_i$ and an engine load value $L_i$ which are derived in correspondence with the (i)th cylinder are read off the analog port 25, and stored in corresponding memory locations $X_{Ni}$ and $X_{Li}$ of the read-write memory 26 in Step 103. A basic injection quantity value To is obtained in Step 104 as a function of the engine speed value $N_i$ and engine load value $L_i$.

Coolant and intake air temperature values THW and THA are read off the intake port 25 in Step 105 to trim the basic injection value To in Step 106 by multiplying To by coefficients which are functions of THW and THA.

As will be understood as description proceeds, learning trimming values are stored in specifically addressable locations of the RAM 26. In response to the (i)th cylinder injection, a learning trimming value $K_i$ is read off the RAM 26 in Step 107 to trim the basic injection quantity value To in Step 108 by multiplying it by a factor $(1+K_i)$ and derive a value on-time value $T_i$ for the (i)th cylinder, the $T_i$ value being stored in a corresponding storage location Yi of the RAM 26 in Step 109 and delivered to the (i)th injection valve 5 in Step 110 through counter unit 30 and amplifier 31.

The microprocessor checks if the engine load and speed are in a steady state and if not, the previous subroutines are repeated until the steady state is attained. For this purpose in Step 111, the microprocessor reads off engine speed values $N_{i-1}$ and $N_i$ and engine load values $L_{i-1}$ and $L_i$, and proceeds to Step 112 to seek an engine speed variation $\Delta N_i$ and an engine load variation $\Delta L_i$ and advances to Step 113 to check if the variations of such engine operating parameters are substantially reduced to zero, and if not, exits to a Step 114 to reset a summed $N_i$ value to zero and jumps to Step 101 to repeat the above process until a steady state is reached.

In order to derive a learning trimming value of fuel injection for the (i)th cylinder, the engine speed value $N_i$ is read off the $X_{Ni}$ location of the RAM 26 in Step 115 and summed with a previous $N_i$ value and stored in a corresponding memory location $X_{Ni}'$ in Step 116. To derive an average engine speed value the previous Steps 101 to 115 are repeated a number of times which equals the number of cylinders multiplied by an integer. For this reason, a "variable" register C is incremented in Step 117 by one each time the Step 116 is executed and the number of such executions is checked against 4k in Step 118, where k is an integer. For the sake of simplicity, $k=1$ is assumed. Following the Step 118 the variable C is reset to zero in Step 119, and engine speed values $N_1$, $N_2$, $N_3$ and $N_4$ are read off memory locations $X_{N1}$, $X_{N2}$, $X_{N3}$ and $X_{N4}$, respectively, in Step 120 which is then followed by a Step 121 where these engine speed values are summed and divided by 4k ($k=1$), thus deriving an average value of the engine speed during a period of four successive fuel injections.

Figure 4A:
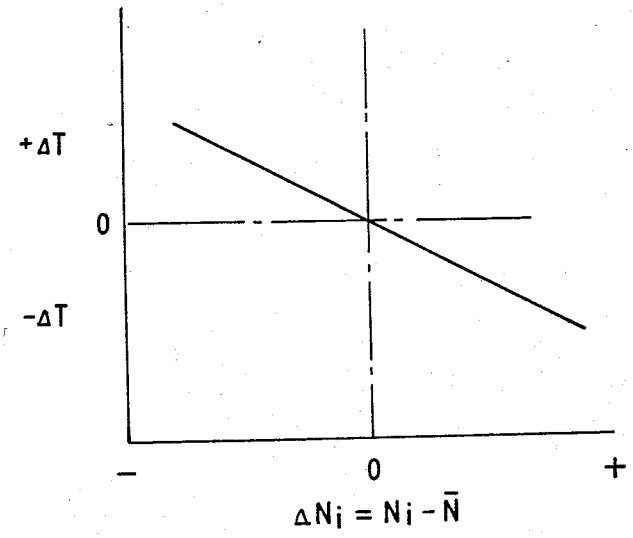
FIGS. 4*a* and 4*b* are graphic illustrations of a unit trimming value as a function of engine speed deviation from an average value.
Figure 4B:
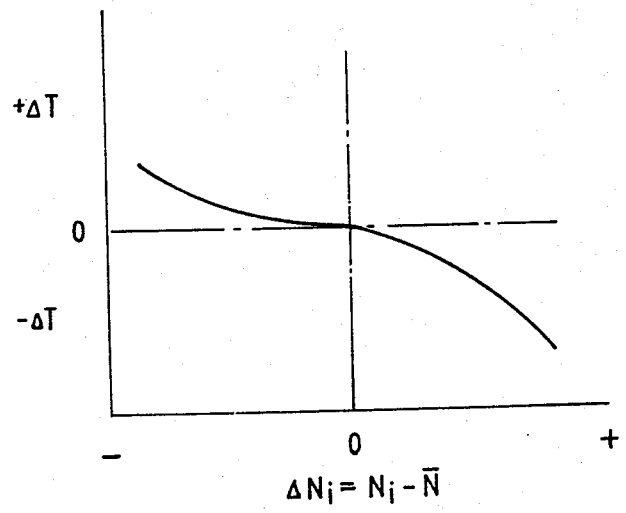

In Step 122 the summed value of $N_i$ stored in $X_{Ni}'$ is reset to zero, and the engine speed value $N_i$ is read in Step 123 from memory location $X_{Ni}$ to derive the deviation of engine speed Ni from the average value in Step 124. The engine speed deviation of the (i)th cylinder injection is checked in Step 125 whether it is zero or positive or negative. If positive, the value on-time value $T_i$ is read off the memory location $Y_i$ in Step 126 and a unit trimming value $\Delta T$ is subtracted from the on-time value $T_i$. If negative, the unit trimming value is added to the on-time value $T_i$ in Step 127. If there is no speed deviation, the on-time value $T_i$ is unaltered. This unit trimming value is variable as a function of the cylinder-to-cylinder engine speed variations $\Delta N_i$. A set of unit trimming values are stored in the RAM 26 in locations addressible as a function of such engine speed variations. As graphically shown in FIG. 4*a*, the positive and negative unit trimming values $\Delta T$ increase linearly with the negative and positive values of cylinder-to-cylinder speed variation $\Delta N_i$. For certain applications, it is preferable that the relationship between these factors be nonlinear as shown in FIG. 4*b* in which the unit trimming value increases progressively with the speed variation.

The microprocessor now advances to Step 128 to detect a deviation $\Delta Ti$ of the on-time value $T_i$ from the basic injection quantity value To. This deviation value of the (i)th cylinder is compared in Step 129 with a reference value "m", and if the latter is exceeded, the deviation $\Delta Ti$ is dismissed as a false indication and the learning trimming value $K_i$ is reset to zero in Step 130. If $\Delta T_i$ is smaller than the reference, the learning trimming value $K_i$ is updated with a ratio $\Delta T_i/To$ at Step 131. After execution of either Steps 130 or 131, the microprocessor returns to Step 101.

Figure 5:
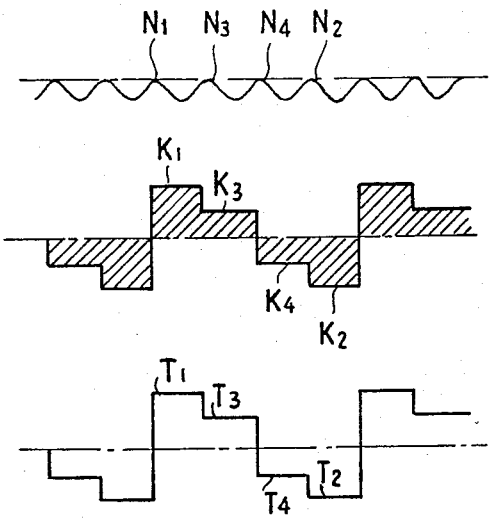
FIG. 5 is a timing diagram useful for describing the advantage of the invention.

It will be understood from the foregoing description that the fuel quantity of the engine is metered individually with respect to each cylinder by compensating for the engine speed deviation of each cylinder from an average value of engine speeds over a series of successive fuel injections. As illustrated schematically in FIG. 5, the learning trimming value $K_i$ will be updated for each fuel injection as shown at $K_1$ to $K_4$ with a different value corresponding to cylinder-to-cylinder engine speed variations and as a result the fuel quantity values $T_i$ of all the cylinders are adjusted individually as shown at $T_1$ to $T_4$. Due to the differences in cross-sectional area between different injectors, the quantities of fuel actually injected to the cylinders are rendered substantially constant and therefore cylinder-to-cylinder speed deviations are minimized as shown at $N_1$ to $N_4$. Furthermore, the constant updating of the learning trimming value $K_i$ compensates for the aging of the injector performance and prolongs their lifetime.

As a result of constant engine speed control, fuel emission, engine idling performance and fuel efficiency during light load operations are improved.

Figure 6:
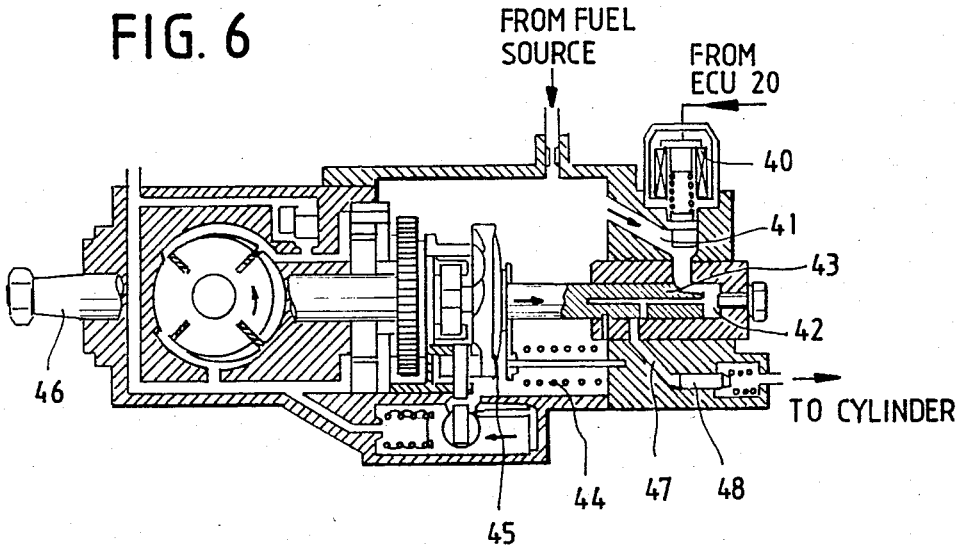
FIGS. 6 and 7 are illustrations of fuel injectors used in diesel engines.
Figure 7:
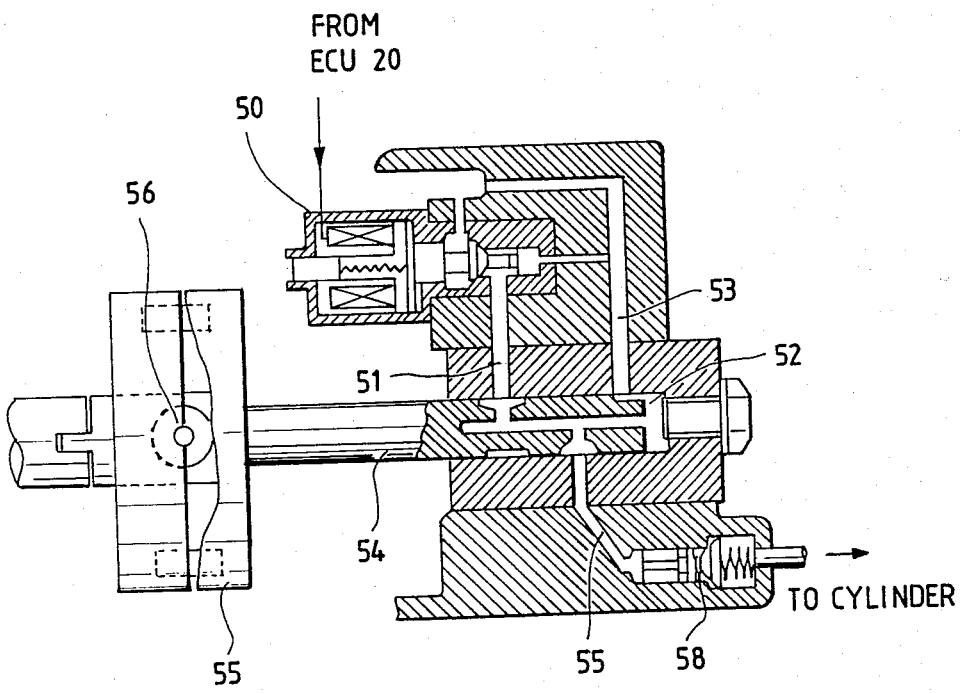

The foregoing description shows a preferred embodiment of the present invention. The present invention could equally be as well applied to fuel metering devices used in diesel engines as shown in FIGS. 6 and 7. The fuel metering device of FIG. 6 comprises a solenoid-operated valve 40 located in a fuel inlet port 41 connected from a fuel tank, not shown, to a pressure chamber 42. A plunger 43 is in camming contact by a spring 44 with a cam 45 which is rotated by the output shaft 46 of the engine 1 so that plunger 43 rotates about its axis and reciprocates in the axial direction in the chamber 42 to thereby pressurize the fuel introduced through the inlet port 41. The leftward movement of the plunger 43 causes the fuel to be drawn into the chamber 42. By the rightward movement and rotary motion of plunger 43, the fuel is pressurized and then allowed to escape through an outlet port 47 overcoming the action of a check valve 48 to an associated cylinder. The solenoid-operated valve 40 is connected to the control unit 20 to receive the fuel injection control pulse to open the inlet port 41.

In FIG. 7 a second type of fuel metering device is shown as comprising a solenoid-operated valve 50 located in a vent passageway 51 which provides communication between a pressure chamber 52 and the atmosphere. Fuel is introduced through an inlet passageway 53 to the chamber 52 where it is pressurized by a plunger 54 having a cam 56 which is in camming contact with a roller 56 coupled to the engine's output shaft. The chamber 52 is in communication with an outlet passageway through which the pressurized fuel is allowed to escape to the cylinder against the action of a check valve 58. The plunger 54 is formed with internal passages through which the fuel is introduced, distributed to the outlet passageway 57 and to the vent passageway as it reciprocates in axial direction and rotates about its axis. Fuel injection begins when the plunger moves into the chamber 52. The valve 50 responds to the fuel injection signal from the control unit 20 by opening the vent passageway 51 to allow the pressurized fuel to pass to the atmosphere to terminate the fuel injection.

What is claimed is:

1. A method for injecting fuel in an internal combustion engine having a plurality of cylinders, comprising the steps of:

(a) successively detecting the speed of said engine at predetermined angular positions of an output shaft of said engine which correspond to said cylinders respectively and generating therefrom a series of first signals representing individual engine speed values of said cylinders;

(b) generating a basic injection control value representing the quantity of fuel to be injected in each of said cylinders as a function of said detected engine speed;

(c) sensing for each of said cylinders when the detected engine speed is steady;

(d) when said detected engine speed is steady, deriving a second signal representing an average value of said first signals during a predetermined period;

(e) successively detecting a deviation of each of said first signals from said second signal;

(f) generating a fuel injection trimming value for each of said cylinders in response to said deviation;

(g) detecting whether said trimming value is smaller or greater than a predetermined value;

(h) if said trimming value is smaller than said predetermined value, trimming said basic injection control value according to said trimming value;

(i) if said trimming value is greater than said predetermined value, resetting said trimming value to zero; and (j) operating each of said fuel injectors in response to said trimmed basic injection control value.

2. A system for controlling an internal combustion engine having a plurality of cylinders and fuel injectors associated respectively with said cylinders, comprising:

first means for continually detecting the speed of said engine to generate an engine speed signal;

second means for sampling said engine speed signal at intervals corresponding to operation of each of said cylinders; and data processing means for:

(a) storing each of said sampled values of said engine speed signal in a memory location corresponding to an associated one of said cylinders;

(b) generating a basic injection control value representing the quantity of fuel to be injected in each of said cylinders as a function of said detected engine speed;

(c) sensing for each of said cylinders when the detected engine speed is steady;

(d) when said detected engine speed is steady, deriving an average value of said stored values;

(e) successively detecting a deviation of each of said stored values from said average value;

(f) generating a fuel injection trimming value for each of said cylinders in response to said deviation;

(g) detecting whether said trimming value is smaller or greater than a predetermined value;

(h) if said trimming value is smaller than said predetermined value, trimming said basic injection control value according to said trimming value;

(i) if said trimming value is greater than said predetermined value, resetting said trimming value to zero; and (j) operating each of said fuel injectors in response to said trimmed basic injection control value.

3. A method as claimed in claim 1, wherein said second signal is an average value of said first signals which are sampled at times equal to the product of the number of said cylinders multiplied by an integer.

4. A system as claimed in claim 2, wherein said average value is derived from said stored values equal in number to the product of the number of said cylinders multiplied by a an integer.

5. A system as claimed in claim 2, wherein:

said system further comprises means for detecting the amount of engine load, and means for detecting the temperature of air taken into said engine and an operating temperature of said engine; and said basic injection control value of said step (b) is generated as a function of said detected engine speed, said engine load, and said temperatures.

6. A system as claimed in claim 2, wherein each of said fuel injectors comprises a solenoid-operated valve of the type used for gasoline engines.

7. A system as claimed in claim 2, wherein each of said fuel injectors comprises:

means forming a chamber, an inlet port supplying fuel from a source to said chamber and an outlet port feeding pressurized fuel from said chamber to an associated one of said cylinders;

means for pressurizing the fuel in said chamber; and a solenoid provided in said inlet port to normally close the same and responsive to said trimmed basic injection control value derived in said steps (h) and (i) to open said inlet port.

8. A system as claimed in claim 2, wherein each of said fuel injectors comprises a valve comprising:

means forming a chamber, an inlet port supplying fuel from a source to said chamber, an outlet port feeding pressurized fuel from said chamber to an associated one of said cylinders, and a vent port communicating said chamber to the atmosphere;

means for pressurizing the fuel in said chamber; and a solenoid valve provided in said vent port to normally close the same and responsive to said trimmed basic injection control value derived in said steps (h) and (i) to open said vent port.

* * * * *